US006871760B1

(12) United States Patent
Snider

(10) Patent No.: US 6,871,760 B1
(45) Date of Patent: Mar. 29, 2005

(54) BOTTLE HAVING RESERVE RESERVOIR

(76) Inventor: Robert J. Snider, 6312 Costello Ave., Valley Glen, CA (US) 91401

( * ) Notice: Subject to any disclaimer, the term of this patent is extended or adjusted under 35 U.S.C. 154(b) by 17 days.

(21) Appl. No.: 10/446,025

(22) Filed: May 28, 2003

Related U.S. Application Data

(60) Provisional application No. 60/387,717, filed on Jun. 11, 2002.

(51) Int. Cl.[7] ..... B67D 5/60
(52) U.S. Cl. ..... 222/129; 222/377; 222/383.1; 222/464.7
(58) Field of Search ..... 222/129, 377, 222/382, 383.1, 385, 464, 464.7

(56) References Cited

U.S. PATENT DOCUMENTS

| | | | | |
|---|---|---|---|---|
| 5,279,450 | A * | 1/1994 | Witt, Jr. | 222/377 |
| 5,464,129 | A * | 11/1995 | Ho | 222/377 |
| 5,518,150 | A * | 5/1996 | Witt, Jr. | 222/377 |
| 6,601,739 | B2 * | 8/2003 | Lacout | 222/321.5 |

* cited by examiner

*Primary Examiner*—Gregory L. Huson
(74) *Attorney, Agent, or Firm*—Roger A. Marrs

(57) ABSTRACT

A container having an internal storage area for holding a quantity of fluid. The top of the bottle is provided with a manual trigger-type pump and includes a downwardly depending tube for conducting or syphoning the fluid from the storage area. The internal storage compartment further includes a reserve reservoir for holding a secondary portion of fluid into which the open end of the tube is disposed after the storage area has been substantially emptied through normal operation of the pump. A small remaining portion of the stored fluid is distributed into the reservoir and the open end of the tube is placed therein so that the last portion of fluid can be dispensed in the normal way by the pump. The secondary or reserve reservoir is defined by a curved inner wall, having opposite ends integrally formed with the side-wall of the bottle. The sidewall is open at its top and tapers gently towards the bottom of the bottle. The edge marginal region of the wall, defining the opening leading into the interior of the secondary or reserve reservoir, constitutes a lip over which the last remaining portion of the fluid will flow when the bottle is tipped forward.

2 Claims, 1 Drawing Sheet

BOTTLE HAVING RESERVE RESERVOIR

This application claims the benefit of Provisional Application Ser. No. 60/387,717 filed Jun. 11, 2002.

BACKGROUND OF THE INVENTION

1. Field of the Invention

The present invention relates to the field of dispensers, storage containers and bottles, and more particularly to a novel bottle having a primary storage area into which fluid is held, and which further includes a reserve reservoir defined by an inner wall serving as a secondary fluid reservoir into which a syphoning or dispensing apparatus is immersed wherein the last remaining portion of the fluid supply can be withdrawn from the bottle.

2. Brief Description of the Prior Art

In the past, it has been the conventional practice to provide a fluid container, such as a bottle, with an internal storage area occupied by a selected fluid. The fluid is normally withdrawn from the interior of the bottle by means of a pump or syphoning means, which includes a hose or tube immersed in the fluid so that upon manual squeezing of a trigger mechanism, the fluid is pumped through the hose or tube into a dispensing jet for distribution externally of the bottle. Although such a bottle is successful for containing a large amount of fluid and for dispensing this fluid through the nozzle, problems and difficulties have been encountered which stem largely from the fact that the tube or hose seldom is effective in withdrawing the last portion of the fluid which is adjacent to the bottom of the bottle. Often times, it is necessary to tip the bottle in various orientations in order to place the end of the hose or tube into the last remaining drops or portion of the fluid. Attempts have been made to avoid this problem by unscrewing the manual pump and filling the container with added water in order to raise the level of the fluid so that the end of the hose or tube is immersed and effective for withdrawing the last portion of the fluid.

Therefore, a long-standing need has existed to provide a bottle for storing of fluids which has a means for collecting the last portion of the fluid into a position or location so that the end of the syphoning tube is immersed in this portion and available for pumping through the nozzle. This would eliminate the need for re-positioning the bottle into various orientations during usage in order to withdraw the last portion of the fluid and would also avoid the necessity of having to add water to the last portion.

SUMMARY OF THE INVENTION

Accordingly, the above problems and difficulties are avoided by the present invention which provides a container, such as a bottle, having an internal storage area for holding a quantity of fluid. The top of the bottle is provided with a manual trigger-type pump and includes a downwardly depending hose or tube for conducting or syphoning the fluid from the storage area. The internal storage compartment further includes a reserve reservoir for holding a secondary portion of fluid into which the open end of the hose or tube is disposed after the storage area has been substantially emptied through normal operation of the pump. A small remaining portion of the stored fluid is distributed into the reservoir and the open end of the tube is placed therein so that the last portion of fluid can be dispensed in the normal way by the pump means. The secondary or reserve reservoir is defined by a curved inner wall, having opposite ends integrally formed with the sidewall of the bottle. The sidewall is open at its top and tapers gently towards the bottom of the bottle. The edge marginal region of the wall, defining the opening leading into the interior of the secondary or reserve reservoir, constitutes a lip over which the last remaining portion of the fluid will flow when the bottle is tipped forward, whereby this last portion of fluid is covering the open end of the syphon hose or tube leading to the manual pump.

Therefore, it is among the primary objects of the present invention to provide a container for fluid intended to be dispensed into the environment which includes a secondary fluid reservoir separate from the primary and major reservoir for the fluid, wherein the last remaining quantity of fluid in the major portion can be introduced into the secondary or reserve reservoir for subsequent dispensing by the manual pump.

Another object of the present invention is to provide a novel bottle having a secondary fluid reservoir defined by an inner wall, in cooperation with the sidewall of the bottle, into which a portion of the main body of fluid can be held, after the main body of fluid has been dispensed.

Yet another object of the present invention is to provide a novel fluid dispensing bottle having a pair of fluid reservoirs or compartments which will allow the user to dispense a total amount of fluid normally carried in the container and to dispense the fluid through the very last drop.

Yet a further object is to provide a bottle having a secondary fluid reservoir for increasing the dispensing efficiency so as to encourage people to buy refills and to reuse the bottle, thus benefiting the environment.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
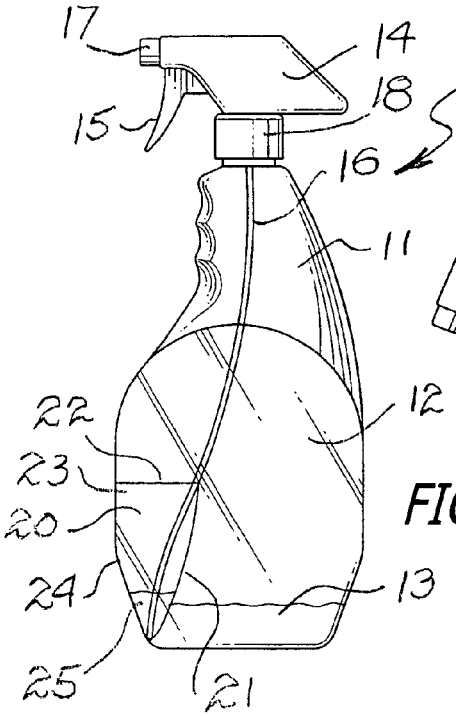
FIG. 1 is a side elevational view of the bottle having a reserve reservoir incorporating the present invention.

Referring to FIG. 1, a container, such as a bottle, having a secondary or reserve reservoir is indicated in the direction of arrow 10, which includes a bottle 11 with a primary sidewall 24 enclosing a major storage internal area, illustrated by numeral 12, into which a bulk quantity of fluid 13 is carried. The fluid 13 is intended to be withdrawn or removed from the major storage area by means of a manual pump, having a body 14 with a trigger 15, for reciprocal operation of a plunger causing the fluid 13 to be drawn through the open end of a hose or tube 16 for dispensing via a nozzle 17. The pumping means can be removably affixed to the top of the bottle 11 by means of a threaded collar 18 with a threaded bottle neck.

FIG. 1 also illustrates that the interior of the bottle includes a secondary or reserve reservoir indicated by numeral 20, which includes a secondary sidewall 21 having an opening at its top, forming a lip, as indicated by numeral 22. The opening is defined by an edge marginal region 23 and it can be seen that the inner wall 21 integrally merges with the primary sidewall 24 of the bottle. A small portion or quantity of bulk liquid is in the bottom of the secondary or reserve reservoir and is indicated by numeral 25. Whether the open end of the hose or tube 16 is immersed in the fluid 13 or 25, pumping action of the trigger 15 will cause withdrawal of the fluid for dispensing through the nozzle 17.

However, when the major portion of the fluid 13 has been dispensed and only a minimum amount of fluid remains at the bottom of the bottle, it is intended that the reservoir 20 be filled with this small portion so that it will constitute the fluid 25. To achieve the filling of the reservoir 20, the bottle is tipped as shown in the direction of the arrow in FIG. 2 so that the fluid 13 flows into the interior of the reservoir 20. The flow of fluid 13 is beyond the edge 22 of the wall 21 and the only direction of flow is into the reservoir 20.

Figure 3:
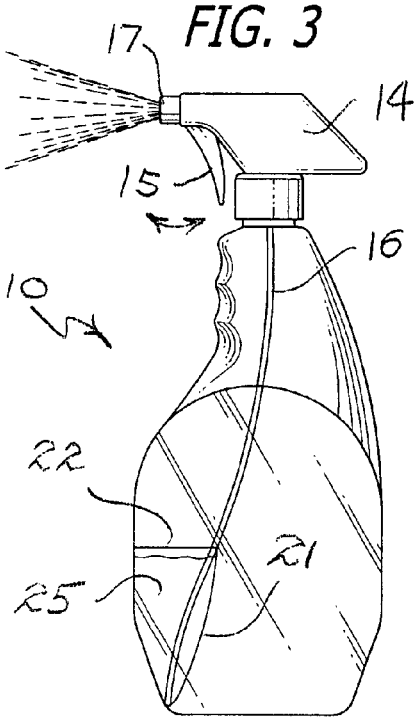
FIG. 3 is a side elevational view of the bottle having the open end of the pumping means hose or tube immersed in the fluid held in the secondary or reserve reservoir.

Upon tipping of the bottle 10 to an upright position as shown in FIG. 3, the quantity of fluid 25 in the reserve reservoir can be dispensed when the open end of the hose 16 is disposed into the interior 20.

Figure 4:
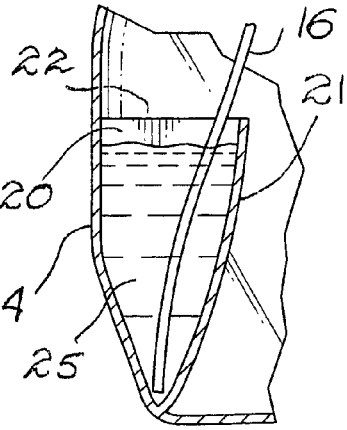
FIG. 4 is an enlarged sectional view of the secondary or reserve reservoir as employed in the bottle shown in FIGS. 1-3 inclusive.

Referring now in detail to FIG. 4, an enlargement of the reserve or secondary reservoir is illustrated with the open end of hose or tube 16 immersed in the last portion of fluid 25 which is in the reserve compartment. Therefore, as the trigger 15 is reciprocally operated, the fluid in the reserve chamber or compartment 20 is withdrawn and dispensed through the nozzle 17.

Figure 2:
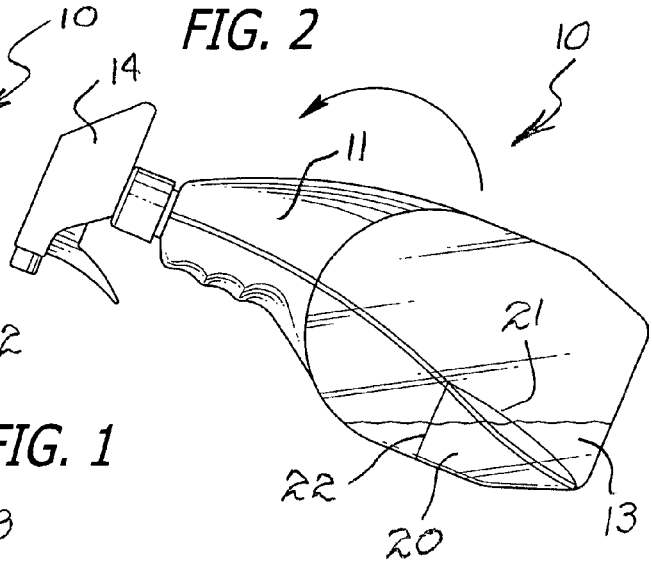
FIG. 2 is a view, similar to the view of FIG. 1, illustrating the fluid in the bottle flowing into the reserve reservoir from the major storage area of the bottle.
Figure 5:
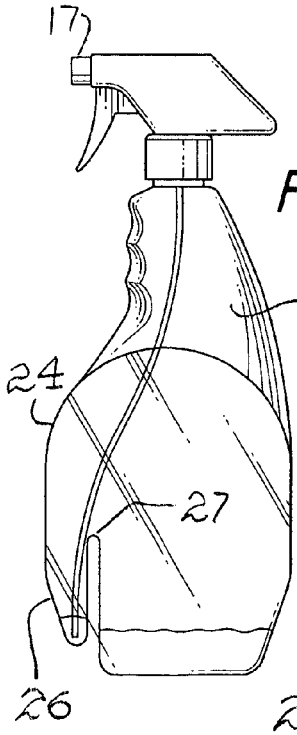
FIG. 5 is a side elevational view of an alternative embodiment of the present invention, wherein the secondary or reserve reservoir is disposed external of the main reservoir of the bottle.

In FIG. 5, another embodiment of the present invention is illustrated wherein the secondary or reserve reservoir or compartment is external of the major portion of the bottle 11 and such a reservoir or compartment is indicated by numeral 26. When it is desired to fill the reservoir with the last small portion of fluid from the main compartment, the bottle 11 is tipped, as illustrated in FIG. 2, so that the fluid will flow over a lip or ledge 27 into the compartment or reservoir 26. The reserve reservoir 26 is defined by a substantially cylindrical or rounded wall serving as an appendage downwardly depending from the ledge 27, creating a space or gap between a major length of the wall and the bottle wall. The cylindrical wall is an extension and continuous with the sidewall 24 of the bottle.

Therefore, it can be seen that the hose 16 runs directly into the secondary or reserve fluid reservoir whether it be reservoir 20 or 26. When the primary fluid 13 is low, the bottle is tipped forward so that the remaining fluid flows over the edge 22 or the ledge 27 into the reserve or secondary reservoir. Then, the bottle is tipped back to its upright position so that the fluid fills the secondary or reserve reservoir. This continues until the bottle is empty. Having a secondary fluid reservoir eliminates the need to add water to the last ounces of fluid in order to withdraw all of the fluid from the bottle. This will allow the user to enjoy the product to the very last drop. The efficiency of the present invention may encourage user's to buy refills and to reuse the bottle, thus benefitting the environment.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A bottle comprising:

an elongated container having a primary sidewall defining on internal fluid storage compartment for holding a bulk supply of fluid;

a reserve reservoir exterior of said internal fluid storage compartment defined by a secondary sidewall having an opening defined by a ledge between said primary sidewall and said secondary sidewall and in communication with said internal fluid storage compartment for holding a portion of said bulk supply of fluid;

said primary sidewall having a mid-section and said opening being in close proximity to said mid-section, whereby tipping of said container permits flow of said bulk supply of fluid to collect in said reservoir to constitute said portion of said bulk supply of fluid;

dispensing means carried on said container for withdrawing and discharging fluid from either said internal fluid storage compartment or said reserve reservoir;

said primary sidewall having a cylindrical wall constituting an extension appendage that is an exterior extension of and continuous with said primary sidewall;

said cylindrical wall defining said appendage downwardly depending from said ledge creating a gap between said primary sidewall and said ledge;

said secondary wall is exterior of said container outwardly projecting from said primary sidewall;

said secondary sidewall being coextensive with said primary sidewall to define said reserve reservoir whereby said container is an integral, unitary construction; and said dispensing means is a manual hand pump detachably carried on said container having an elongated tube extending between a discharge nozzle and either said internal fluid storage compartment or said reserve reservoir.

2. The bottle defined in claim 1 wherein:

said appendage constitutes a handle for holding said bottle.

* * * * *